US007292213B2

(12) United States Patent
Shen

(10) Patent No.: US 7,292,213 B2
(45) Date of Patent: Nov. 6, 2007

(54) METHOD AND DEVICE FOR REPAIRING DEFECTIVE PIXELS OF A LIQUID CRYSTAL DISPLAY PANEL

(75) Inventor: Chien-Ching Shen, Shin-Shih Village (TW)

(73) Assignee: Chi Mei Optoelectronics Corp., Hainan (TW)

( * ) Notice: Subject to any disclaimer, the term of this patent is extended or adjusted under 35 U.S.C. 154(b) by 538 days.

(21) Appl. No.: 10/647,264

(22) Filed: Aug. 26, 2003

(65) Prior Publication Data

US 2004/0041977 A1 Mar. 4, 2004

(30) Foreign Application Priority Data

Aug. 26, 2002 (TW) ..... 91119315

(51) Int. Cl.
*G09G 3/36* (2006.01)

(52) U.S. Cl. ..... 345/89; 345/204; 345/904; 345/87; 345/98; 348/245; 348/246; 348/247; 349/192

(58) Field of Classification Search ..... 349/192; 345/89, 87, 98, 104, 204, 904; 348/245–247
See application file for complete search history.

(56) References Cited

U.S. PATENT DOCUMENTS 5,289,174 A * 2/1994 Suzuki ..... 345/98
5,708,451 A * 1/1998 Baldi ..... 345/75.2
5,764,209 A * 6/1998 Hawthorne et al. ..... 345/87
5,793,344 A * 8/1998 Koyama ..... 345/87
5,828,368 A * 10/1998 Jung ..... 345/213
6,271,825 B1 * 8/2001 Greene et al. ..... 345/694
6,822,628 B2 * 11/2004 Dunphy et al. ..... 345/75.2
6,917,410 B2 * 7/2005 Song et al. ..... 349/178

* cited by examiner

*Primary Examiner*—Bipin Shalwala
*Assistant Examiner*—Sameer Gokhale
(74) *Attorney, Agent, or Firm*—Rabin & Berdo PC

(57) ABSTRACT

A method and device for repairing defective pixels of a liquid crystal display panel. First, examine the liquid crystal panel to obtain the locations of defective pixels on a liquid crystal display. Next, input a pixel signal wherein the pixel signal further comprises a pixel brightness signal used to control a pixel with a first brightness according to the pixel signal. When the pixel signal is used to be inputted to the defective pixel, the pixel brightness signal of the pixel signal will be replaced by a default brightness signal wherein the default brightness signal controls the pixel with a second brightness. Of which, the second brightness, whose level of brightness is of complete darkness for instance, is dimmer than the first brightness. At last, output pixel signals.

14 Claims, 4 Drawing Sheets

METHOD AND DEVICE FOR REPAIRING DEFECTIVE PIXELS OF A LIQUID CRYSTAL DISPLAY PANEL

This application clams the benefits of Taiwan application Serial No. 91119315, filed Aug. 26, 2002.

BACKGROUND OF THE INVENTION

1. Field of the Invention

The invention relates in general to a drive device and a drive method for the pixels of a liquid crystal display, and more particularly to a device and a method for repairing the defective pixels of a liquid crystal display.

2. Description of the Related Art

While display technology is experiencing continual progress, the liquid crystal display (LCD) has become a mainstream product in the field of displays due to its advantages of low radiation and low power consumption as well as its physical features of being thin, small and short in size, and light in weight.

A liquid crystal display panel includes a plurality of pixels arranged in the form of a matrix and displays the picture by inputting individual pixel data to control the brightness of a pixel.

A diversity of errors might occur during the manufacturing process of a display. For instances, the first metallic layer short-circuiting with the second metallic layer or the photoresist coating applied on the glass base panel peeling off will cause structural defects to a pixel. Under these circumstances, a pixel would be unable to display the corresponding brightness in response to the pixel data received. For example, the peeling off of photoresist coating will make a corresponding pixel much brighter than its adjacent pixels resulting in a bright spot defect. For the convenience of description, a pixel with structural defects is referred to as a 'defective pixel' hereinafter while a pixel, which always displays a higher level of brightness due to the peeling off of photoresist coating, a "bright spot". Bright spots not only deteriorate the display quality of a liquid crystal display panel but also reduce consumers' purchasing willingness.

Currently, the method for repairing the bright spot problem of a liquid crystal display panel is to repair the defective structure of a defective pixel and the peeling off of photoresist coating either manually or automatically. Since a pixel is small in size but complex in structure, it is difficult and time-consuming trying to examine and locate defective pixels to further fix the defective structures. It is not economical in terms of the cost and labor required. Moreover, some of the structural defects cannot be repaired properly. Therefore, how to reduce the negative influence on the display quality of a liquid crystal display panel caused by defective pixels has become an important issue.

SUMMARY OF THE INVENTION

It is therefore an object of the invention to provide a device and a method for repairing defective pixels of a liquid crystal display panel to resolve the bright spot problem on a liquid crystal display panel caused by defective pixels in a more economical way which requires less time, money and labor.

It is another object of the invention to provide a device for repairing defective pixels of a liquid crystal display panel wherein the device for repairing defective pixels includes a defective pixel signal storage unit, a pixel signal storage unit, a location comparison unit and a pixel signal replacement unit. The defective pixel storage unit is used to output defective pixel signals, which represent the locations of defective pixels on a liquid crystal display. The pixel signal storage unit is used to output pixel signals while the pixel signal further comprises a first brightness and a pixel location signal, which represents the location of a pixel on a liquid crystal display. The location comparison unit, which is coupled to the defective pixel signal storage unit and the pixel signal storage unit respectively, is used to compare the defective pixel signal with the pixel location signal to determine whether the pixel signal is used to be inputted to the defective pixel signal or not. The pixel signal replacement unit is coupled to the location comparison unit. When the pixel signal is used to be inputted to the defective pixel, the pixel brightness signal of the pixel signal will be replaced by a default brightness signal wherein the default brightness signal controls the pixel with a second brightness.

It is another object of the invention to provide a method for repairing defective pixels of a liquid crystal display panel wherein the method for repairing defective pixels includes at least the following steps. First, obtain the locations of defective pixels on a liquid crystal display. Next, input a pixel signal wherein the pixel signal further includes a first pixel brightness signal used to control a pixel with a first brightness according to the pixel signal. When the pixel signal is used to be inputted to the defective pixel, the first pixel brightness signal of the pixel signal will be replaced by a default brightness signal wherein the default brightness signal controls the pixel with a second brightness. Of which, the second brightness, whose level of brightness can be of complete darkness for instance, is dimmer than the first brightness. Last, output pixel signals.

Other objects, features, and advantages of the invention will become apparent from the following detailed description of the preferred but non-limiting embodiments. The following description is made with reference to the accompanying drawings.

DETAILED DESCRIPTION OF THE INVENTION

The technology of the invention is featured by replacing the pixel signals inputted to defective pixels with default pixel data of dark spots, so that the brightness of defective pixels as displayed on a liquid crystal display panel will constantly be of complete darkness. By doing so, not only can the bright spot problem caused by defective pixels be resolved, but also the display quality of a liquid crystal display panel be improved.

Figure 1:
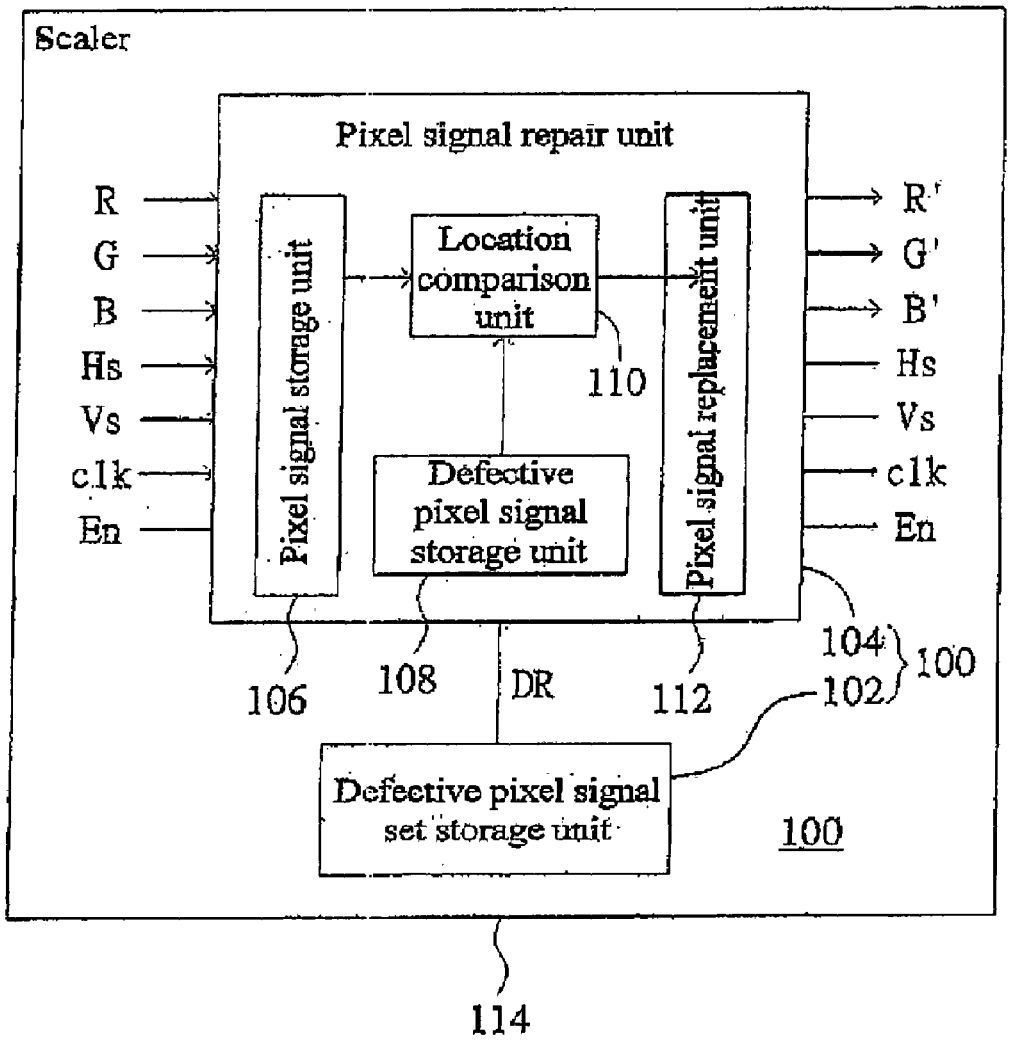
FIG. 1 shows a block diagram of a device for repairing defective pixels of a liquid crystal display panel according to a preferred embodiment of the invention.

FIG. 1 shows a block diagram of a device for repairing defective pixels of a liquid crystal display panel according to a preferred embodiment of the invention. The defective pixel repairing device 100 includes a defective pixel signal set storage unit 102 and a pixel signal repair unit 104, wherein the pixel signal repair unit 104 further includes a pixel signal storage unit 106, a defective pixel signal storage unit 108, a location comparison unit 110 and a pixel signal replacement unit 112. Of which, the location comparison unit 110 is coupled to pixel signal storage unit 106 and defective pixel signal storage unit 108, whereas the pixel signal replacement unit 112 is coupled to the location comparison unit as shown in FIG. 1. It is noteworthy that the defective pixel-repairing device 100 can be an independent circuit device or partly or totally installed in other circuit devices. For example, the user can install the entire defective pixel repairing device 100 in a scaler 114 or other well-known circuit devices, or just install the entire or part of pixel signal repair unit 104 in a scaler or other well-known circuit devices.

Figure 2:
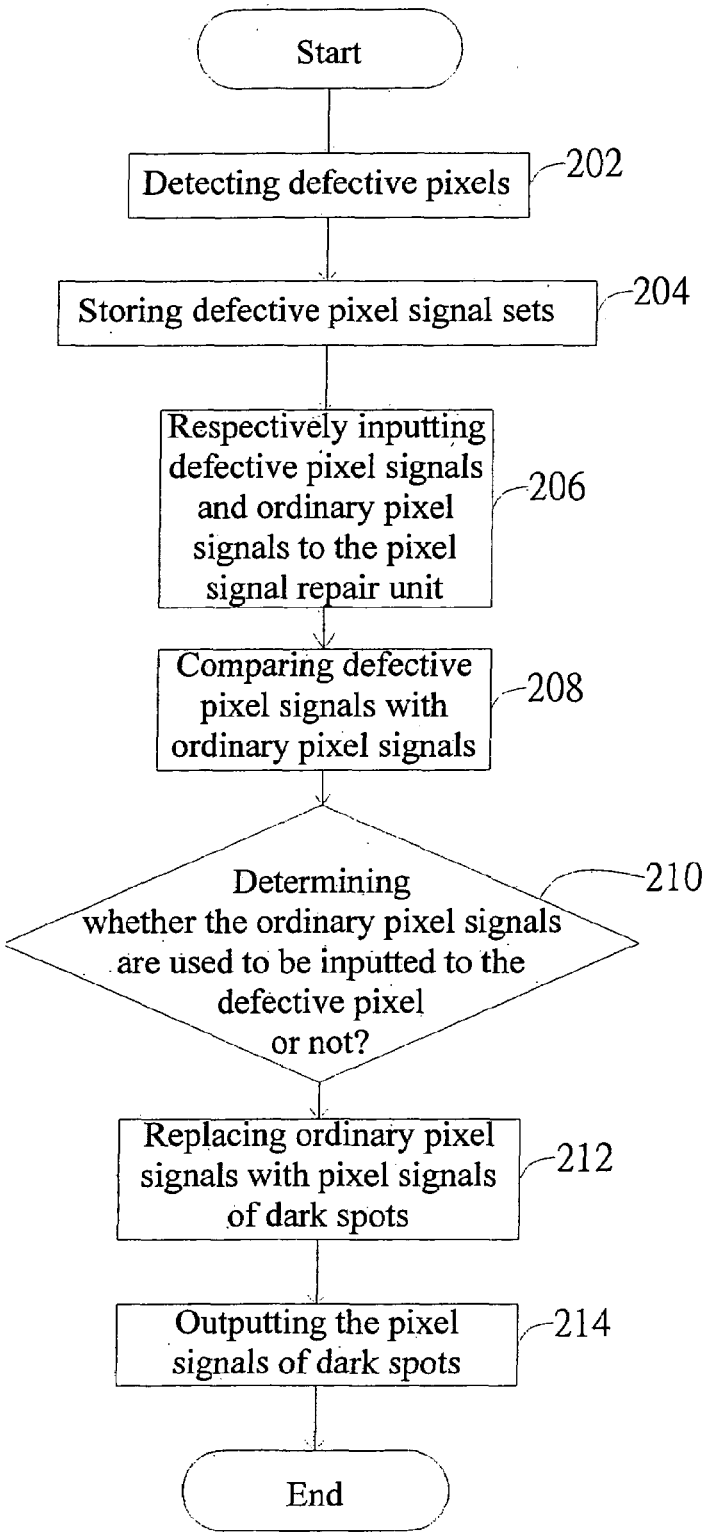
FIG. 2 shows a flowchart of a device for repairing defective pixels of a liquid crystal display panel according to a preferred embodiment of the invention.

FIG. 2 shows a flowchart of a device for repairing defective pixels of a liquid crystal display panel according to a preferred embodiment of the invention. First, perform step 202 to examine the liquid crystal display panel and obtain the location of every defective pixel on the liquid crystal display. Next, perform step 204 to store the location of every defective pixel on the liquid crystal display panel in the defective pixel signal set storage unit 102 in the form of a defective pixel signal set. In the preferred embodiment of the invention, the location of every defective pixel on the liquid crystal display panel is represented by a defective pixel signal in the form of co-ordinates. Assemble all the defective pixel signal to form a set of defective pixel signals and store the set in the defective pixel signal set storage unit 102 wherein the defective pixel signal set storage unit 102 can be a micro controller or an integrated circuit (IC).

Figure 3A:
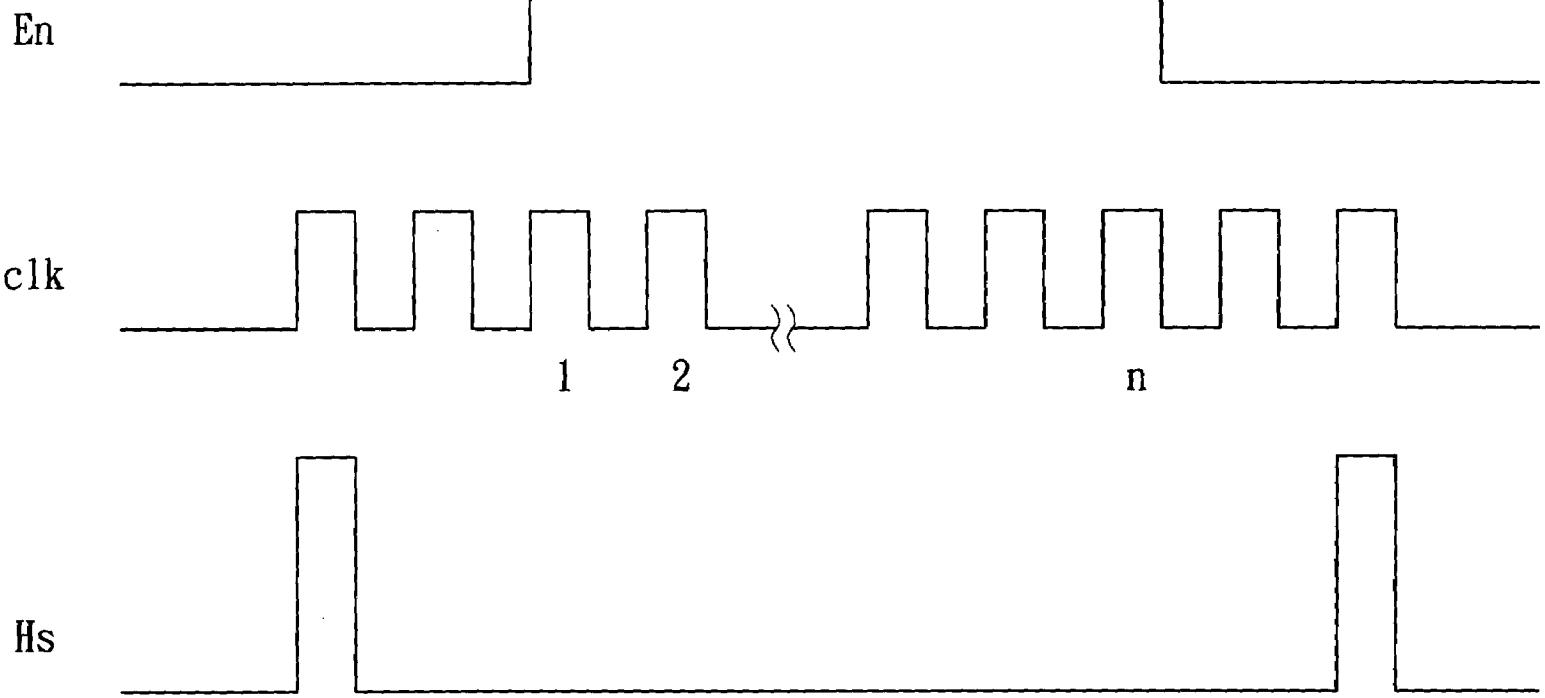
FIGS. 3A~3B are schematic diagrams illustrating the locations of pixels on a display panel represented by the enabling signal, the clock signal, the horizontal synchronous signal and the vertical synchronous signal.
Figure 3B:
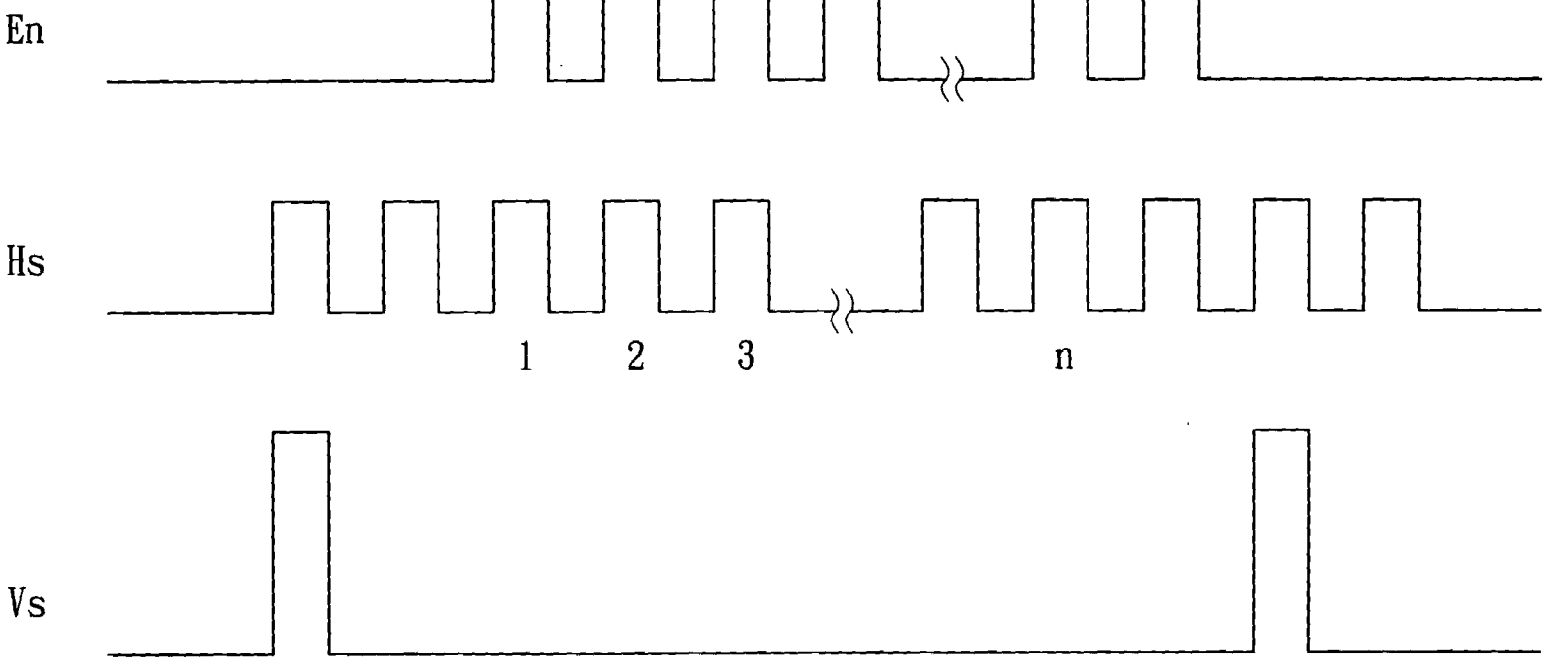

Following that, perform step 206 which inputs defective pixel signals and ordinary pixel signals to the defective pixel signal storage unit 108 and the pixel signal storage unit 106 respectively, wherein the ordinary pixel signal further comprises a pixel brightness signal used to make the pixel which receives the pixel signal display brightness according to the pixel brightness signal. A chromatic liquid crystal display panel has three kinds of pixels used to represent the red color (R), the green color (G) and the blue color (B) respectively, and so do pixel brightness signals have the red color (R), the green color (G) and the blue color (B). Besides, an ordinary pixel signal further comprises a pixel location signal used to represent the location of the intended pixel of the pixel signal on a liquid crystal display. The location signal comprises a horizontal synchronous signal (Hs), a vertical synchronous signal (Vs), a clock signal (clk) and an enabling signal (En). FIGS. 3A~3B are schematic diagrams illustrating the locations of pixels on a display panel represented by the enabling signal, the clock signal, the horizontal synchronous signal and the vertical synchronous signal. Referring to FIG. 3A, the horizontal location of a pixel on a liquid crystal display panel can be represented by the enabling signal, the clock signal, and the horizontal synchronous signal. Referring to FIG. 3B, the vertical location of a pixel on a liquid crystal display panel can be represented by the enabling signal, the clock signal, and the vertical synchronous signal. For example, the pixel located in the $2^{nd}$ column and the $3^{rd}$ row of a liquid crystal display panel can be represented using a clock signal labeled "2" in FIG. 3A and a horizontal synchronous signal labeled "3" in FIG. 3B.

After that, perform step 208 where the pixel signal storage unit 106 inputs ordinary pixel signals and the defective pixel signal storage unit 108 inputs defective pixel signals to the location comparison unit 110 respectively. The location comparison unit 110 obtains the location of a defective pixel according to the defective pixel signal and, according to the location pixel signal of an ordinary pixel signal, obtains the location of the pixel inputted by the ordinary pixel signal.

Next, perform step 210. After the location comparison unit 110 has compared ordinary pixel data and defective pixel data and has determined that the ordinary pixel signal is used to be inputted to a defective pixel, then perform step 212 to replace the pixel brightness signal of an ordinary pixel signal with the brightness signal of a dark spot. The signal value of the brightness signal of a dark spot is used to make the pixel constantly display a level of complete darkness. The brightness signal of a dark spot is of low voltage if a vertical alignment (VA) mode liquid crystal display panel is used and is of high voltage if a twisted nematic (TN) mode liquid crystal display panel is used. In the invention, the pixel signal whose pixel brightness signal is replaced by brightness signal of a dark spot is called a "dark spot pixel signal".

At last, perform step 214, which outputs the pixel signal. The method for repairing defective pixels according to the invention ends here.

The method for repairing defective pixels of a liquid crystal display panel disclosed in the above preferred embodiments of the invention constantly set the brightness of defective pixels to be of complete darkness by controlling the pixel brightness signal of the inputted defective pixel. By doing so, not only can the bright spot problem caused by defective pixels be resolved economically in terms of time, money and labor, but also the display quality of a liquid crystal display panel be improved as well.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for repairing defective pixels of a liquid crystal display panel, wherein the method comprises at least the steps of:

(a) obtaining the location of a defective pixel on the liquid crystal display;

(b) inputting a pixel signal, wherein the pixel signal comprises a pixel brightness signal used to control a pixel to have a brightness according to the pixel signal;

(c) replacing the pixel brightness signal with a default brightness signal if the pixel signal is used to be inputted to the defective pixel, wherein the default brightness signal is used to control the pixel to be substantially completely dark; and (d) outputting the pixel signal inputted to the defective pixel in step (c) to repair the defective pixel.

2. The method according to claim 1, wherein the default brightness signal is of low voltage if the liquid crystal display panel is a vertical alignment (VA) mode liquid crystal display panel.

3. The method according to claim 1, wherein the default brightness signal is of high voltage if the liquid crystal display panel is a twisted nematic (TN) mode liquid crystal display panel.

4. The method according to claim 1, wherein the pixel signal further comprises a pixel location signal, which represents the location of the pixel on the liquid crystal display.

5. The method according to claim 4, wherein the pixel location signal further comprises a clock signal, an enabling signal, a vertical synchronous signal and a horizontal synchronous signal.

6. The method according to claim 4, wherein by comparing the pixel location signal with the location of the defective pixel, a determination is made as to whether or not the pixel signal is used to be inputted to the defective pixel.

7. The method according to claim 1, further comprising the step of replacing each of the pixel brightness signals corresponding to the defective pixels with the default brightness signal, if the liquid crystal display panel has a plurality of defective pixels, so that all of the defective pixels are controlled to be substantially completely dark.

8. A device for repairing defective pixels of a liquid crystal display, comprising at least:

a defective pixel storage unit used to output a defective pixel signal, wherein the defective pixel signal is used to represent the location of the defective pixel on the liquid crystal display;

a pixel signal storage unit used to output a pixel signal, wherein the pixel signal comprises a pixel brightness signal used to control a pixel with a brightness and a pixel location signal used to represent the location of a pixel on the liquid crystal display;

a location comparison unit, which, being coupled to the defective pixel signal storage unit and the pixel signal storage unit respectively, is used to compare the defective pixel signal with the pixel location signal to determine whether the pixel signal is used to be inputted to the defective pixel; and a pixel signal replacement unit coupled to the location comparison unit for replacing the pixel brightness signal with a default brightness signal if the pixel signal is determined to be inputted to the defective pixel, wherein the default brightness signal is used to control the pixel to be substantially completely dark to repair the defective pixel.

9. The device according to claim 8, wherein the default brightness signal is of high voltage if the liquid crystal display is a VA mode liquid crystal display panel.

10. The device according to claim 8, wherein the default brightness signal is of high voltage if the liquid crystal display is a TN mode liquid crystal display panel.

11. The device according to claim 8, wherein the pixel location signal comprises a clock signal, an enabling signal, a vertical synchronous signal and a horizontal synchronous signal.

12. The device according to claim 8, wherein the device for repairing defective pixels of a liquid crystal display panel is installed in a scaler.

13. The device according to claim 8, wherein part of the elements of the device for repairing defective pixels of a liquid crystal display panel is installed in a scaler.

14. The device according to claim 8, further comprising the step of using the pixel signal replacement unit to replace each of the pixel brightness signals corresponding to the defective pixels with the default brightness signal so that all of the defective pixels are controlled to be substantially completely dark, if the liquid crystal display panel has a plurality of defective pixels.

* * * * *